US008460479B2

(12) United States Patent
Haeberle et al.

(10) Patent No.: US 8,460,479 B2
(45) Date of Patent: Jun. 11, 2013

(54) DOOR ASSEMBLY FOR A DISHWASHING APPLIANCE, AND ASSOCIATED APPARATUSES AND METHODS

(75) Inventors: Robert Haeberle, New Bern, NC (US); Dennis A. Poyner, Kinston, NC (US); David Sumner, Greenville, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 743 days.

(21) Appl. No.: 12/124,550

(22) Filed: May 21, 2008

(65) Prior Publication Data

US 2009/0288692 A1 Nov. 26, 2009

(51) Int. Cl.
*B08B 3/00* (2006.01)

(52) U.S. Cl.
USPC ..... 134/58 D; 134/56 D; 134/57 D

(58) Field of Classification Search
USPC ..... 134/56 D, 57 D, 58 D
See application file for complete search history.

(56) References Cited

U.S. PATENT DOCUMENTS

| | | | | |
|---|---|---|---|---|
| 3,294,461 | A | 12/1966 | Barnard et al. | |
| 3,837,120 | A * | 9/1974 | Hanks et al. | 49/489.1 |
| 3,883,201 | A | 5/1975 | Busoni | |
| 4,004,326 | A * | 1/1977 | Beavers | 166/241.6 |
| 4,732,431 | A | 3/1988 | Mason | |
| 4,765,697 | A | 8/1988 | Gardell et al. | |
| 5,039,828 | A * | 8/1991 | Marks et al. | 174/135 |
| 5,924,433 | A * | 7/1999 | Thies et al. | 134/200 |
| 6,622,896 | B2 * | 9/2003 | Hegeman et al. | 222/651 |
| 6,736,470 | B2 * | 5/2004 | Manke et al. | 312/228 |
| 6,875,918 | B2 | 4/2005 | Sudo et al. | |
| 7,014,281 | B2 | 3/2006 | Wuestefeld et al. | |
| 7,071,411 | B2 | 7/2006 | Beele | |
| 7,137,173 | B2 | 11/2006 | Sipple | |
| 7,216,944 | B2 | 5/2007 | Oyler et al. | |
| 7,415,984 | B2 * | 8/2008 | Flowers et al. | 134/57 D |
| 2003/0041523 | A1 * | 3/2003 | Kiesler et al. | 49/490.1 |
| 2003/0205954 | A1 * | 11/2003 | Oyler et al. | 312/311 |
| 2004/0177869 | A1 * | 9/2004 | Flowers et al. | 134/57 D |
| 2005/0079739 | A1 * | 4/2005 | Illerhaus | 439/33 |
| 2006/0157086 | A1 * | 7/2006 | Kappler et al. | 134/34 |
| 2006/0289197 | A1 | 12/2006 | Yabe | |

FOREIGN PATENT DOCUMENTS

| | | | |
|---|---|---|---|
| EP | 1193132 | A2 * | 4/2002 |
| JP | 54065753 | A2 | 5/1979 |
| JP | 2002282190 | A * | 10/2002 |

* cited by examiner

*Primary Examiner* — Michael Barr
*Assistant Examiner* — Charles W Kling
(74) *Attorney, Agent, or Firm* — Alston & Bird LLP

(57) ABSTRACT

A door assembly and associated components for a dishwashing appliance are provided, wherein the dishwashing appliance includes a tub portion defining a forward access opening. The door assembly is pivotably engaged with the tub portion and cooperates therewith to cover the forward access opening. The door assembly includes an integrally formed and structurally reinforced inner door member, without a separate reinforcement panel. The inner door member includes at least one reinforcing member integrally formed therewith and along a contour thereof so as to provide reinforcement thereof. The dishwashing appliance further includes a covering member configured to encompass a wiring arrangement associated with the inner door member, for protecting the wiring arrangement within the dishwashing appliance. Associated apparatuses and methods are also provided.

49 Claims, 11 Drawing Sheets

DOOR ASSEMBLY FOR A DISHWASHING APPLIANCE, AND ASSOCIATED APPARATUSES AND METHODS

BACKGROUND OF THE INVENTION

1. Field of the Invention

Embodiments of the present invention relate to dishwashing appliances and, more particularly, to a door assembly for a dishwashing appliance, and apparatuses and methods associated therewith.

2. Description of Related Art

A washing appliance, such as a dishwasher, generally includes a tub portion having a forward-facing vertical opening, wherein a door is engaged with the tub portion so as to be pivotable about the lower end of the tub portion and to close the tub opening during the washing process. In this regard, conventional dishwasher models typically include a door having a separate polymeric "inner lining" (i.e., the inward surface of the door facing the interior of the tub portion). However, in such instances, if the polymeric inner lining is to be used for any structural purpose in the dishwasher, the inner liner must be appropriately reinforced by another separate structure. For example, a door assembly may include a plastic door liner and a metal reinforcement panel which is staked to the plastic door liner. In such instances, the metal reinforcement panel provides additional stiffness, strength, and provisions to which to attach various mechanisms and components, such as counterbalance arms/hinges, for providing the pivotable engagement with the tub portion. However, the additional metal reinforcement panel may undesirably increase the cost of the dishwasher, and the staking process for joining the metal reinforcement panel to the plastic door liner may be difficult and labor intensive, resulting in excessive rework and scrap.

Such a dishwasher door assembly may also include a control panel engaged therewith for controlling various components of the dishwasher. Accordingly, appropriate wires or a dedicated wiring harness, connecting to the control panel, are often run outside the metal reinforcement panel (i.e., the metal reinforcement panel separates the wires running to the control panel from the plastic or polymeric inner liner). However, the wiring harness must be routed over existing structures associated with the door, and may thus rub or chafe against, for example, a hinge support rod for facilitating a pivoting motion of the door assembly, and/or a kickplate positioned on the forward side of the dishwasher about a base thereof, when opening and closing the dishwasher door assembly. As such, conventional dishwashers having such a configuration may often implement a chafe guard for the wiring harness such as, for example, a protective corrugated tubing wrapping about the wiring harness, as the wiring harness runs about the structures associated with the bottom of the door assembly to the operative components of the dishwasher, which are typically housed within the base of the dishwasher under the tub portion.

Further, a dishwasher door configured in such a manner may use the metal reinforcement panel as a "flame barrier". That is, the metal reinforcement panel may act as a barrier for flame advancement should the wiring harness catch on fire. However, the metal reinforcement panel may not necessarily be configured to prevent fluid leakage from contacting the wiring harness. As such, in some instances, leakage of some liquids, such as a rinse aid from the detergent dispenser, may cause deterioration of the insulation of the wires of the wiring harness, which may lead to the aforementioned fire hazard.

The "chafe guard", if implemented, may not necessarily be fire-resistant or liquid/chemical-resistant.

Thus, there exists a need for an apparatus and method for a washing appliance for reducing the production costs and improving production efficiency associated with the washing appliance. There further exists a need for an apparatus and method for reducing hazards associated with control panel wiring extending within a door assembly of a dishwasher.

BRIEF SUMMARY OF THE INVENTION

The above and other needs are met by the present invention which, according to one aspect, provides a door assembly for a dishwashing appliance having a tub portion defining a forward access opening, wherein the door assembly is pivotably engaged with the tub portion and is adapted to cooperate with the tub portion to cover the forward access opening. Such a door assembly comprises an integrally-formed inner door member having a liner surface facing toward the tub portion and an opposing structural surface. The inner door member is adapted to pivotably engage the tub portion about a lower end thereof. The liner surface defines at least one contour, and the structural surface has at least one reinforcing member integrally engaged therewith in correspondence with the at least one contour defined by the liner surface, so as to structurally reinforce the inner door member.

Another aspect provides a dishwashing appliance comprising a tub portion having a plurality of wall members defining a forward access opening, and a door assembly configured to cooperate with the tub portion to cover the forward access opening. The door assembly comprises an integrally-formed inner door member having a liner surface facing toward the tub portion and an opposing structural surface. The inner door member is configured to pivotably engage the tub portion about a lower end thereof. The liner surface defines at least one contour, and the structural surface has at least one reinforcing member integrally engaged therewith in correspondence with the at least one contour defined by the liner surface, so as to structurally reinforce the inner door member.

Yet another aspect provides a method of forming a dishwashing appliance, wherein the dishwashing appliance includes a tub portion having a plurality of wall members and defining a forward access opening. Such a method comprises pivotably engaging a door assembly with the tub portion about a lower end thereof such that the door assembly cooperates with the tub portion to cover the forward access opening thereof, wherein the door assembly comprises an integrally-formed inner door member having a liner surface facing toward the tub portion and an opposing structural surface, with the inner door member being configured to pivotably engage the tub portion about a lower end thereof, the liner surface defining at least one contour, and the structural surface having at least one reinforcing member integrally engaged therewith in correspondence with the at least one contour defined by the liner surface so as to structurally reinforce the inner door member.

Thus, the various aspects of the present invention provide advantages, as otherwise detailed herein, that may include, but are not limited to: providing a dishwashing appliance assembly including a door assembly and tub portion that are engaged with one another in a manner such that production costs are reduced and production efficiency is improved, and providing protective measures for reducing hazards/risks associated with the wiring used to power the operational components of the dishwasher.

BRIEF DESCRIPTION OF THE SEVERAL VIEWS OF THE DRAWINGS

Figure 1:
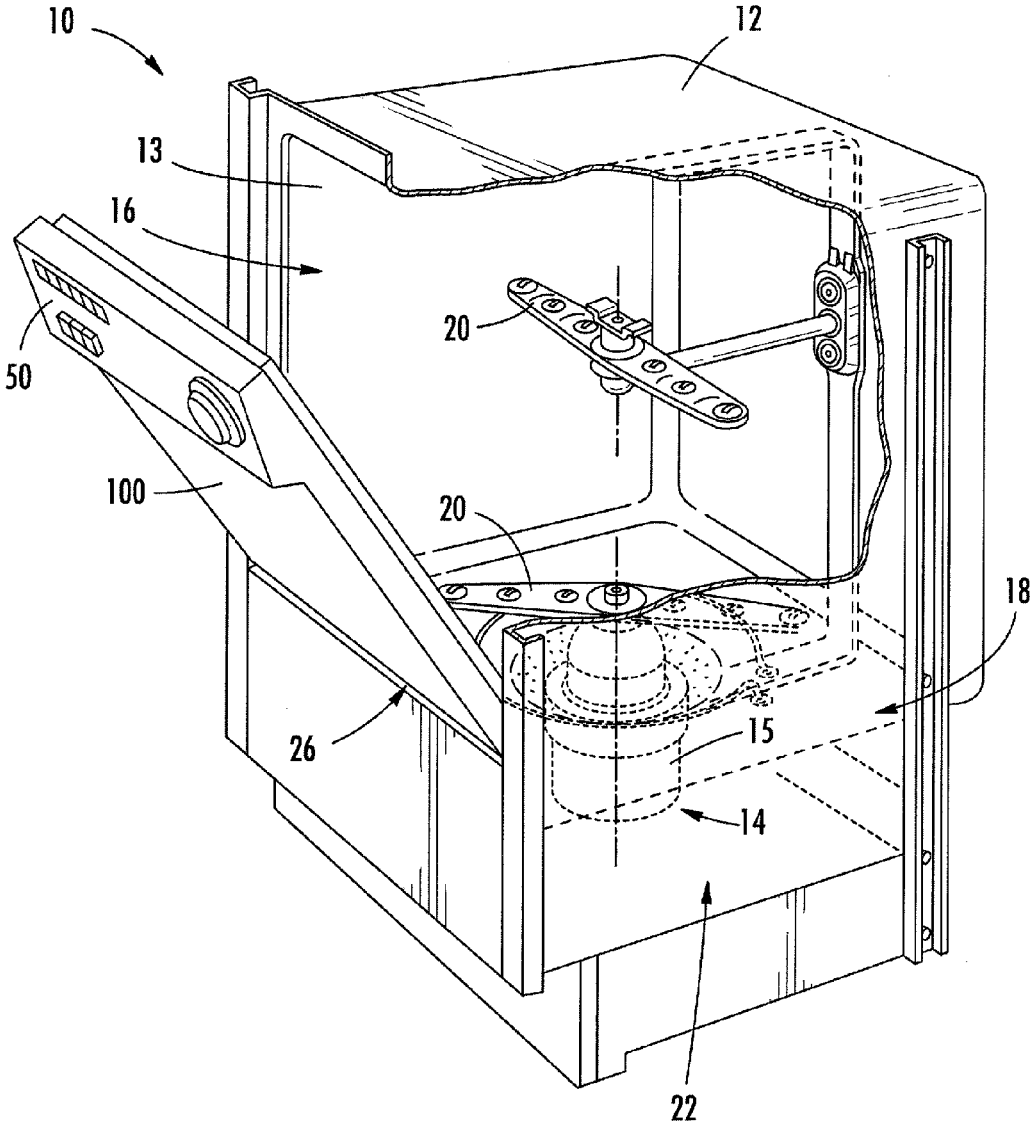
Figure 2:
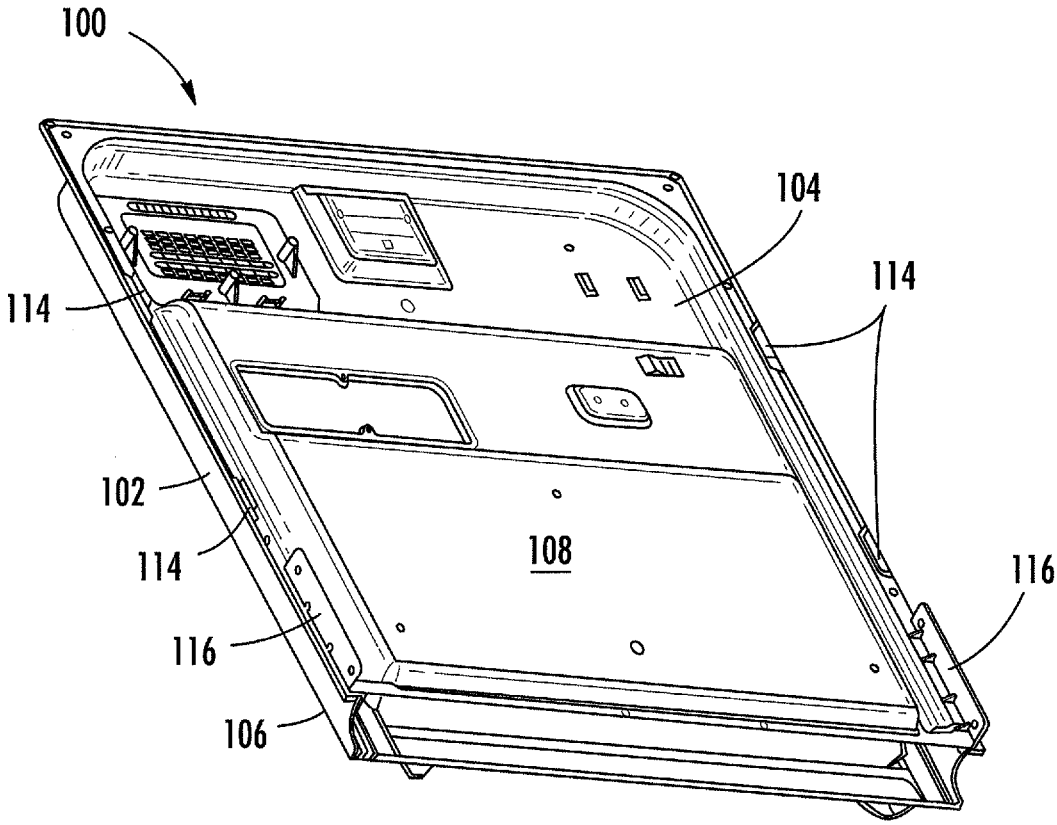
FIG. 2 PRIOR ART
Figure 3:
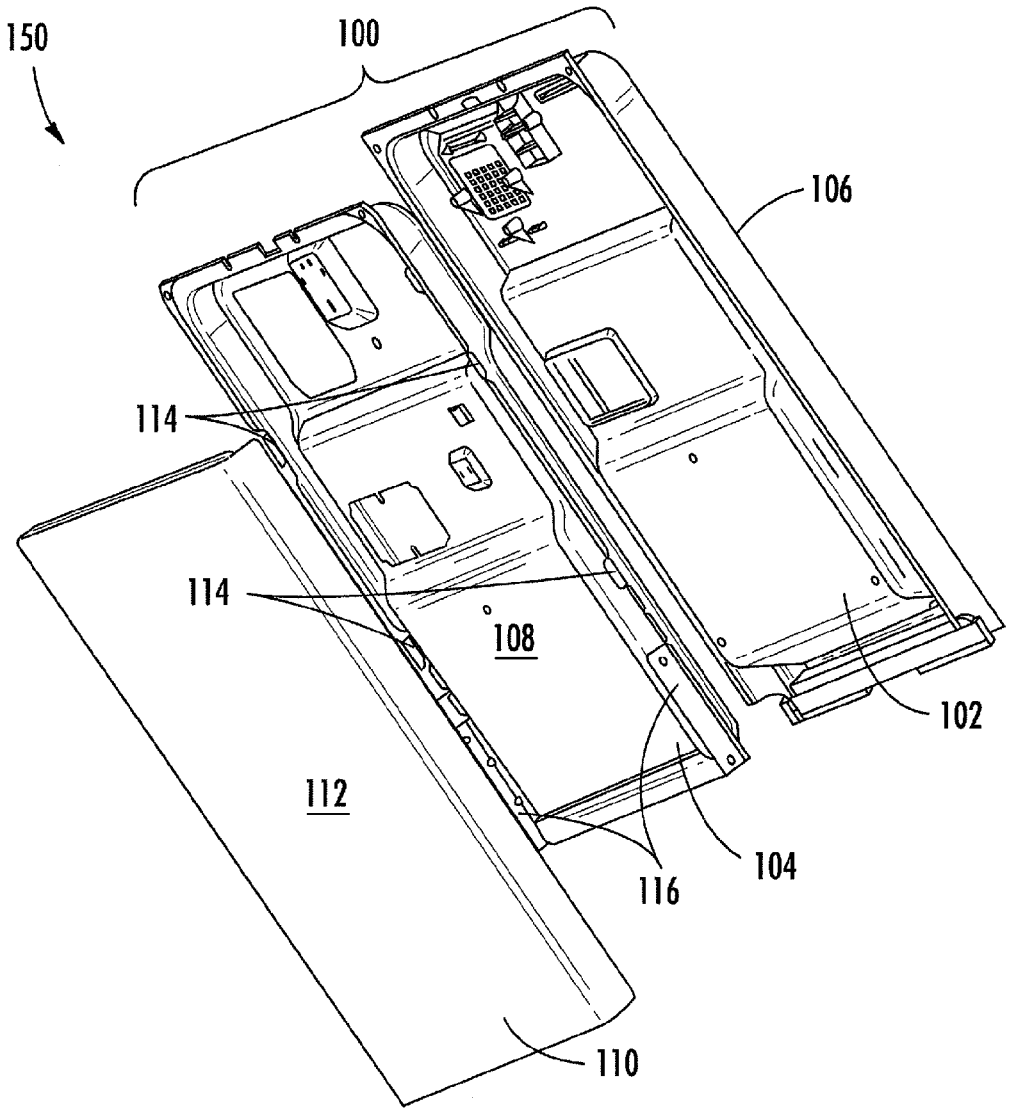
FIG. 3 PRIOR ART
Figure 4:
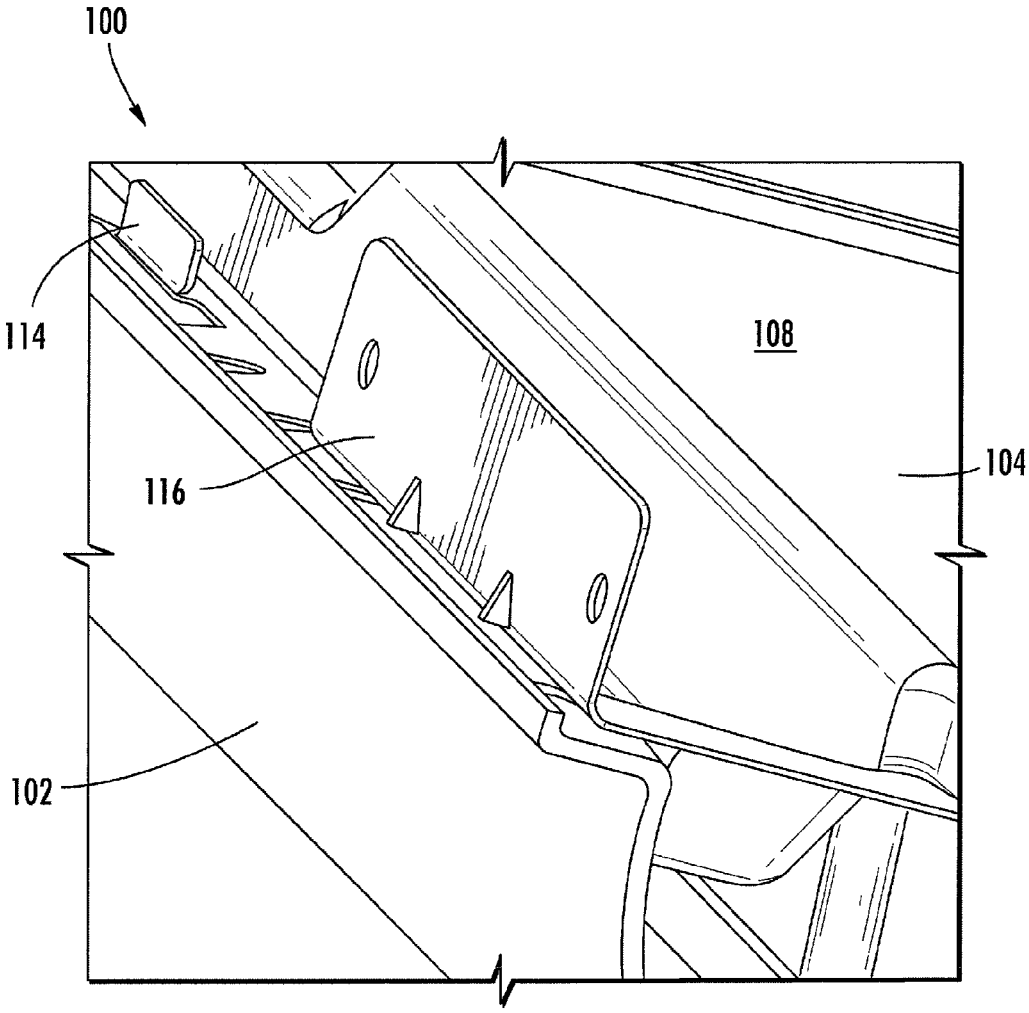
FIG. 4 PRIOR ART
Figure 5:
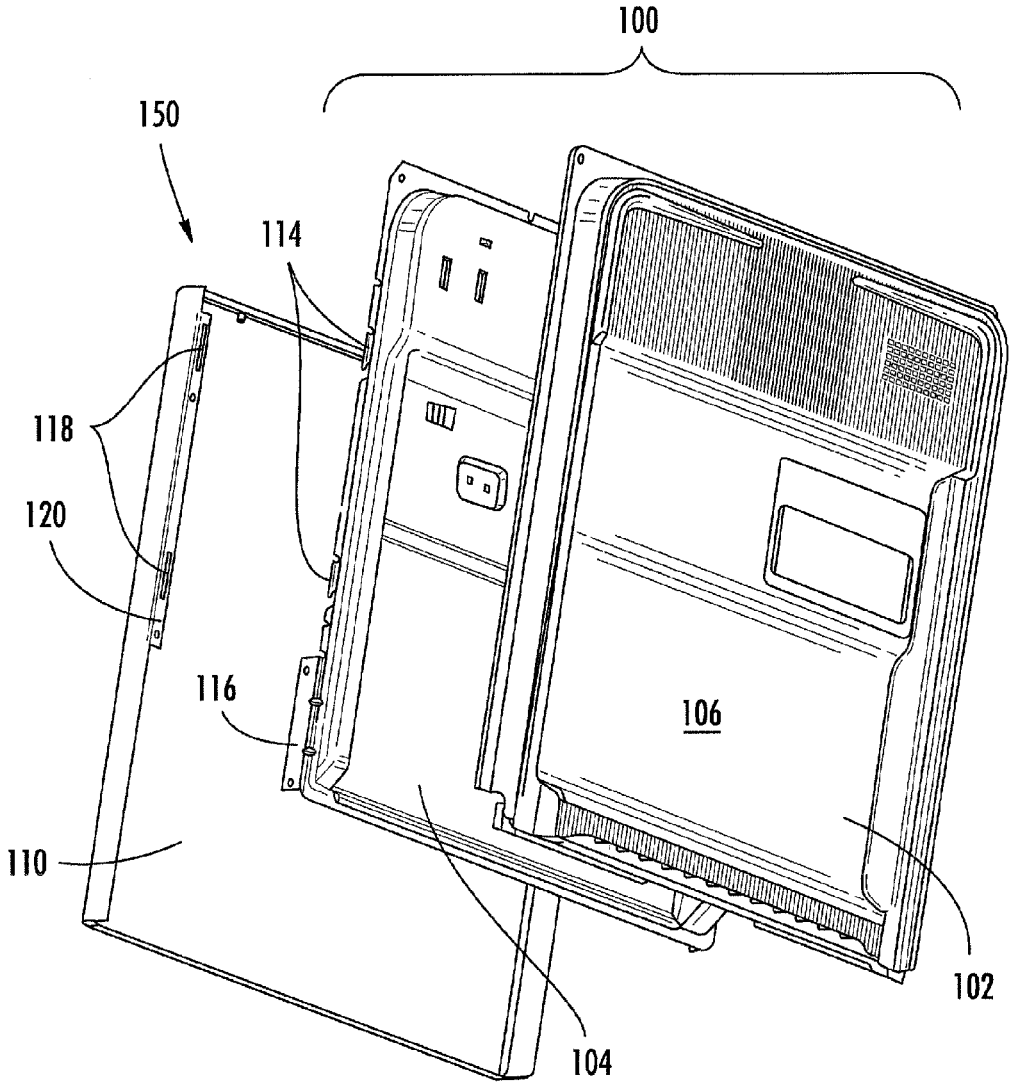
FIG. 5 PRIOR ART
Figure 6:
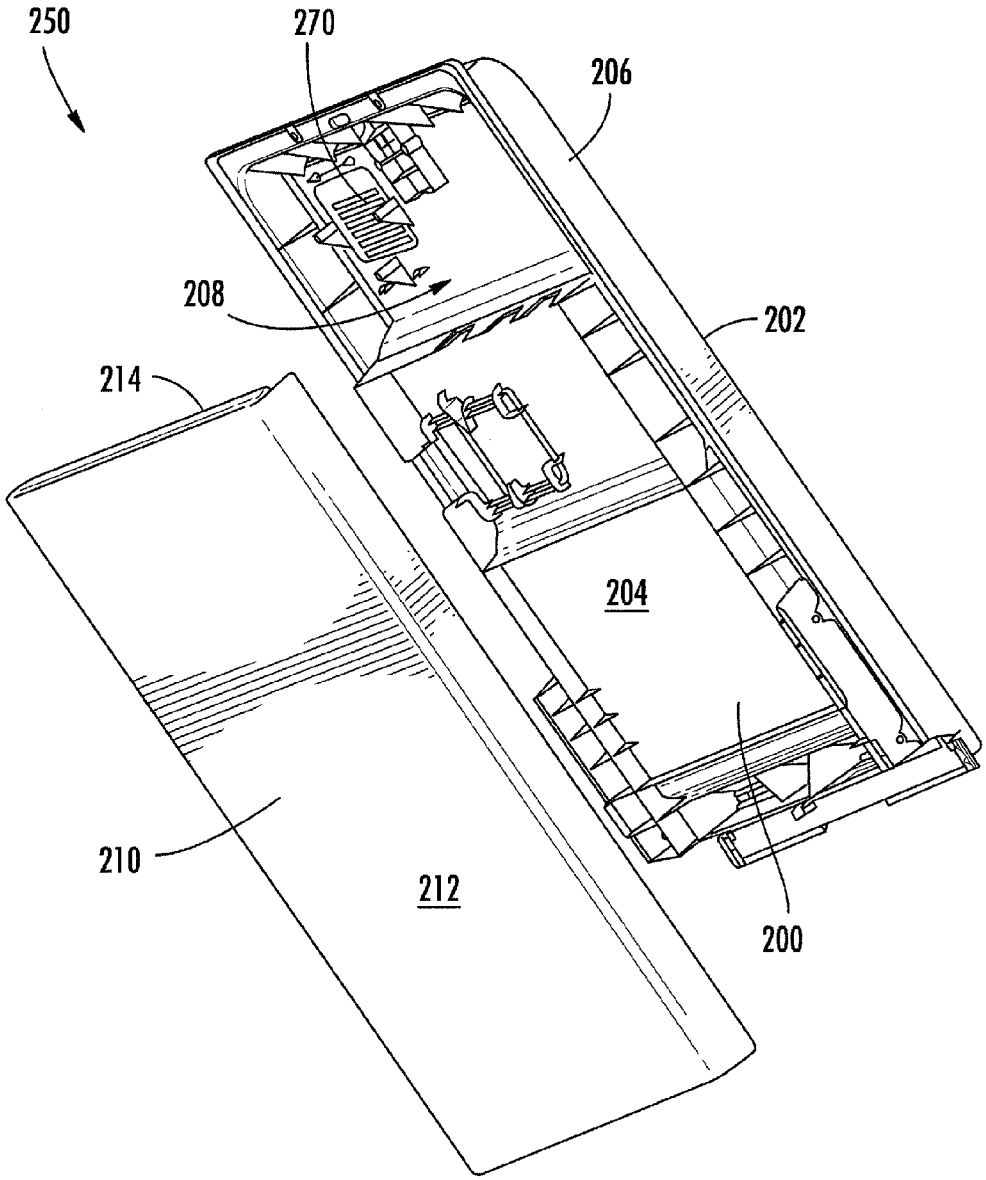
Figure 7:
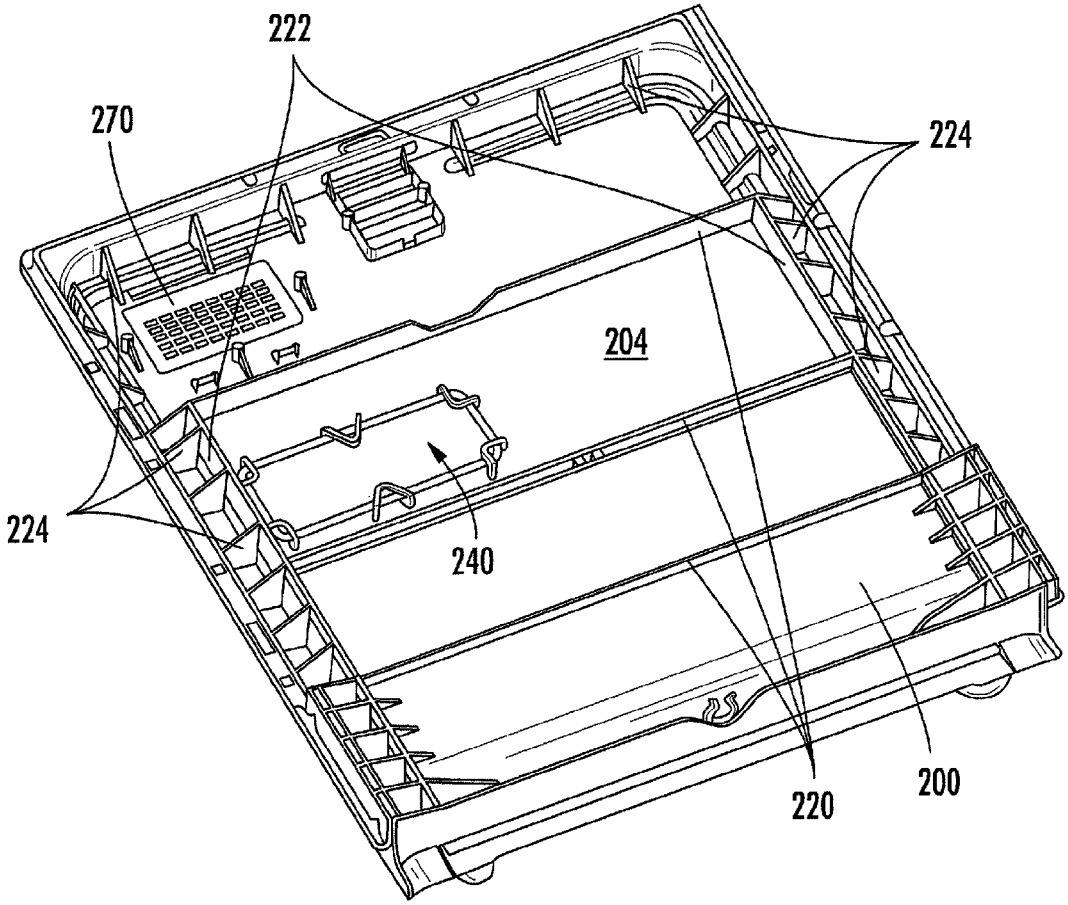
Figure 8:
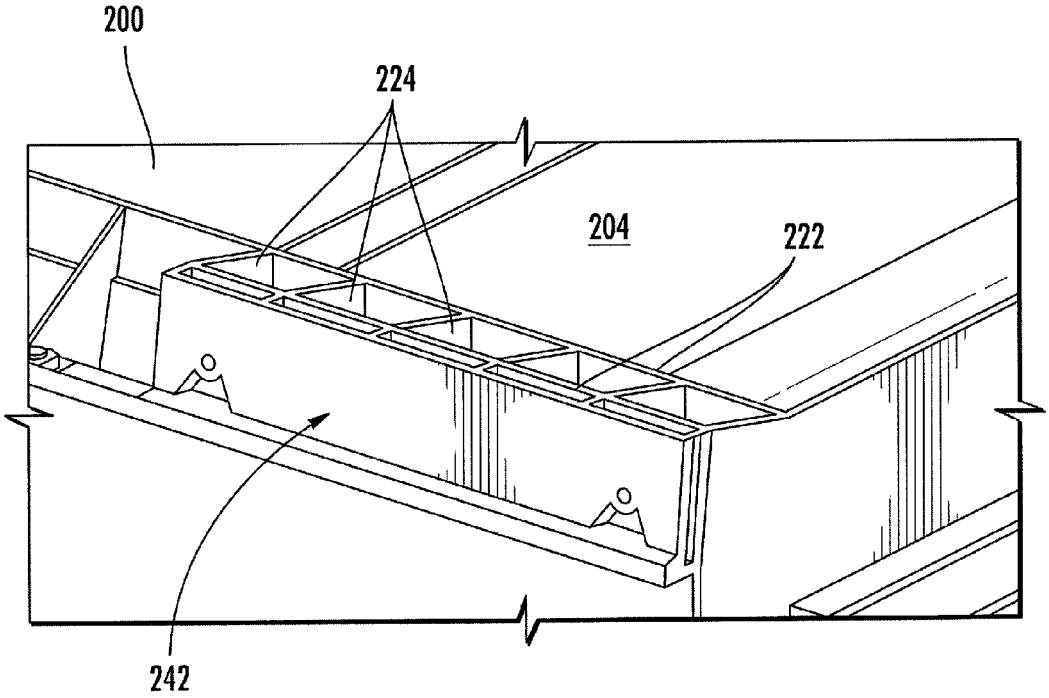
Figure 9A:
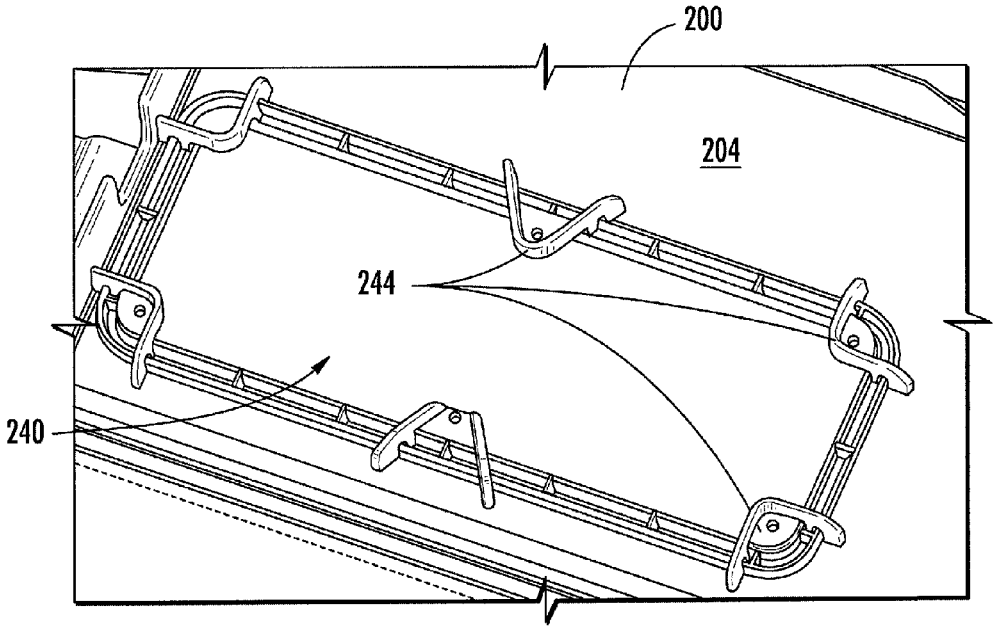
Figure 9B:
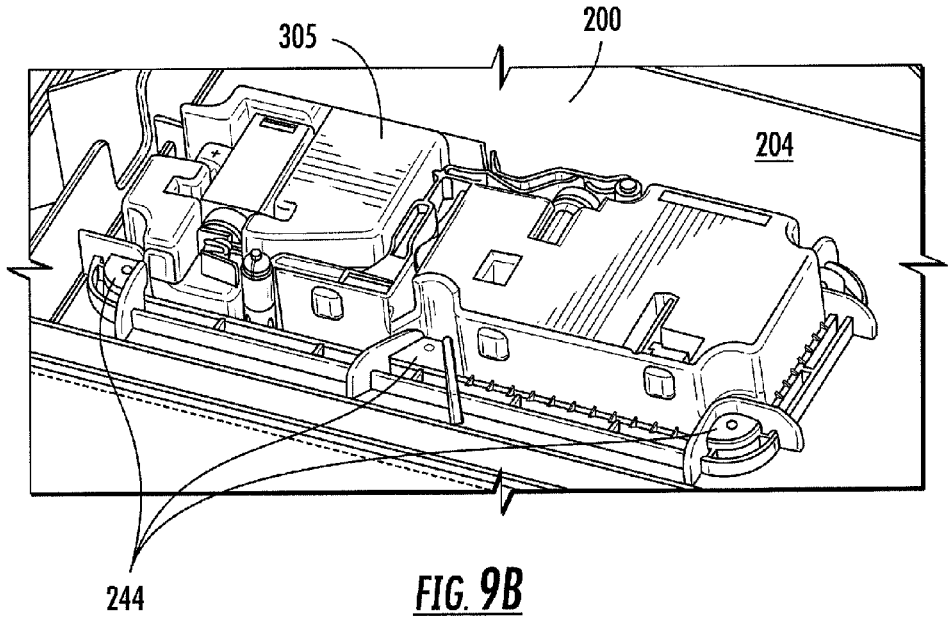
Figure 10A:
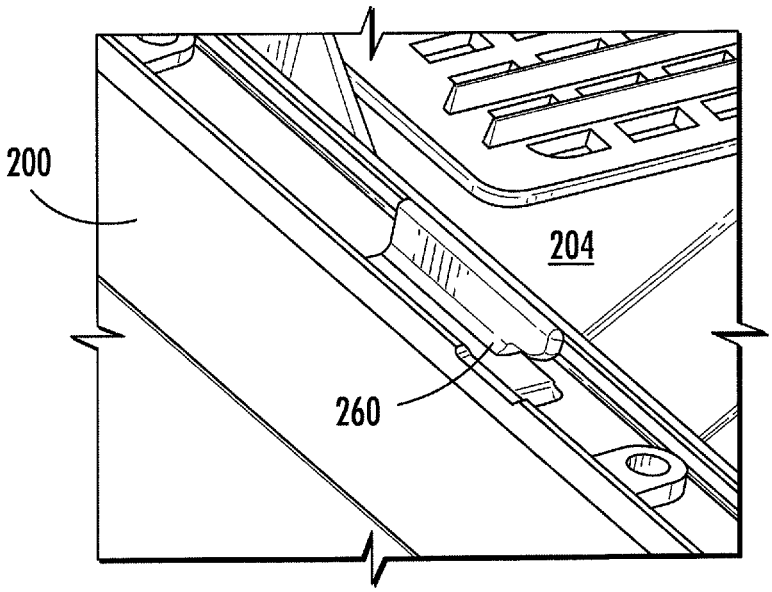
Figure 10B:
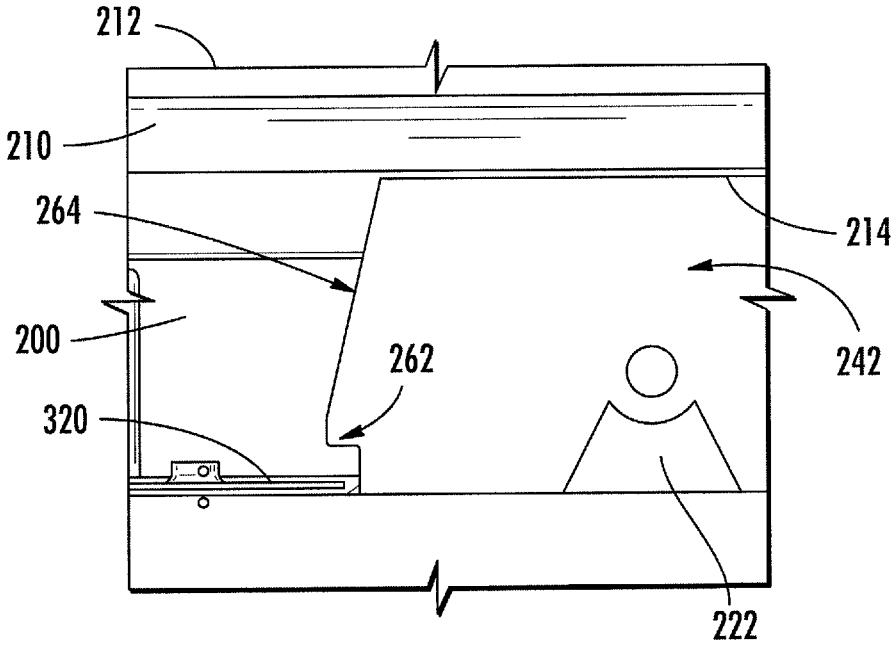
Figure 11A:
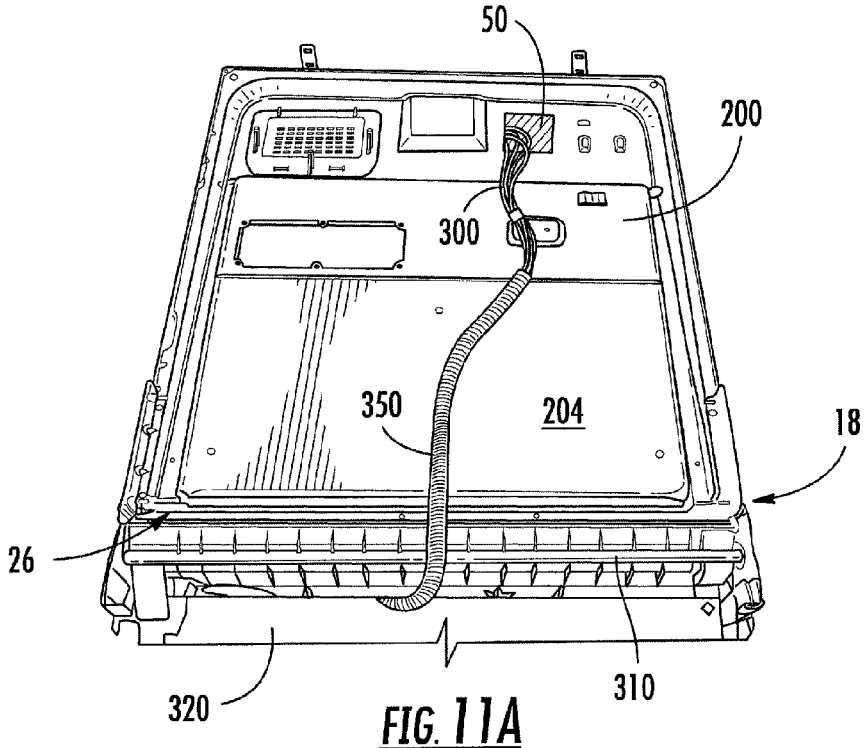
Figure 11B:
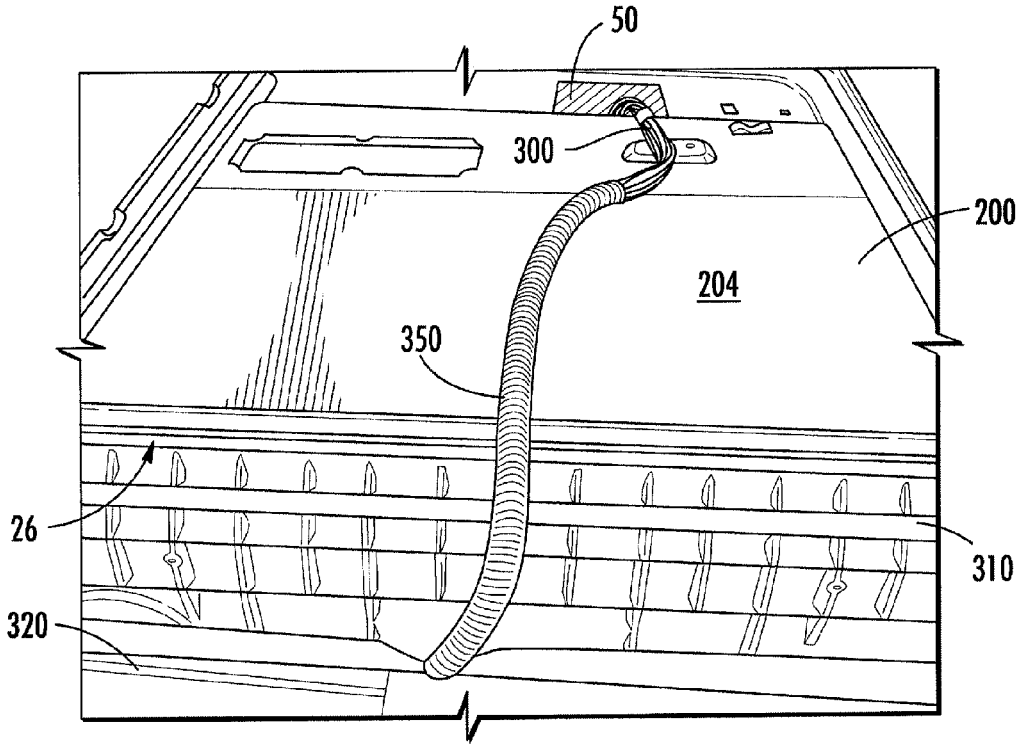

Having thus described various embodiments of the invention in general terms, reference will now be made to the accompanying drawings, which are not necessarily drawn to scale, and wherein:

FIG. 1 is a perspective view of a dishwasher of a type suitable for use with various embodiments of the present disclosure;

FIG. 2 is a perspective view of a prior art inner door assembly for a dishwasher, wherein the inner door assembly includes a liner panel and a separate reinforcement panel;

FIG. 3 is an exploded perspective front view of a prior art door assembly implementing the inner door assembly of FIG. 2;

FIG. 4 is a partial perspective view of the prior art inner door assembly of FIG. 2, having an engagement feature for engaging an outer panel of a door assembly;

FIG. 5 is an exploded perspective rear view of a prior art door assembly implementing the inner door assembly of FIG. 2;

FIG. 6 is an exploded view of a door assembly, according to one embodiment of the present invention, having an integrally-formed inner door panel and an outer decorative door panel;

FIG. 7 is a perspective view of an inner door panel configured to operably engage a tub portion of a washing appliance, according to one embodiment of the present invention;

FIG. 8 is a partial perspective rear view of the inner door panel of FIG. 7, according to one embodiment of the present invention, illustrating an integral structure configured to operably engage a pivoting component for coupling the inner door panel with the tub portion;

FIGS. 9A and 9B are partial perspective views of the inner door panel of FIG. 7, according to one embodiment of the present invention, illustrating a structure integral to the inner door panel being configured to receive a dispersion device;

FIG. 10A is a partial perspective view of the inner door panel of FIG. 7, according to one embodiment of the present invention, illustrating a structure integral with the inner door panel for operably engaging the outer decorative door panel thereto;

FIG. 10B is a cross-sectional side view of a door assembly having an engagement mechanism, according to one embodiment of the present invention, for coupling an inner door panel of the door assembly and an outer decorative door panel of the door assembly; and FIGS. 11A and 11B are perspective views of a dishwashing appliance with the outer decorative door panel removed from the inner door panel so as to illustrate a wire covering encompassing a wiring arrangement, according to one embodiment of the present invention.

DETAILED DESCRIPTION OF VARIOUS EMBODIMENTS OF THE INVENTION

Various embodiments of present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates one example of a dishwasher 10 capable of implementing various embodiments of the present invention. Such a dishwasher 10 typically includes a tub portion 12 (partly broken away in FIG. 1 to show internal details, and also referred to herein as "tub" or "tub 12") having a plurality of walls (e.g., side wall 13) for forming an enclosure in which dishes, utensils, and other dishware may be placed for washing. The tub portion 12 may also define a forward access opening, generally designated as 16. As known in the art, the dishwasher 10 may also include slidable bottom and upper racks (not shown) for holding the dishes, utensils, and dishware. The tub portion 12 may define a sump, generally designated as 14, in which wash water or rinse water is collected, typically under the influence of gravity. The wash/rinse water may be pumped by a pump 15 out of the sump 14 to various spray arms 20 mounted in the interior of the tub portion 12 for spraying the wash/rinse water, under pressure, onto the dishes, utensils, and other dishware contained therein. The pump 15 and/or other operational components (e.g., circulation pump, drain pump, water valve) may be housed, disposed, or otherwise positioned within a base portion/component 22 positioned beneath the tub portion 12, wherein the base portion 22 receives and supports a lower end, generally designated as 18, of the tub portion 12. In some instances, the base portion 22 may be a separate component with respect to the tub portion 12, such as, for example, a molded polymer component, while in other instances the base portion 22 may be integral with the tub portion 12 such that the side walls forming the tub portion 12 also at least partially form the base portion 22.

A door assembly 100 may be pivotably engaged with the tub portion 12 about the lower end 18 thereof so as to selectively permit access to the interior of the tub. That is, a lower edge 26 of the door assembly 100 may be pivotably engaged (i.e., hinged) with the lower end 18 of the tub portion 12 such that the door assembly 100 is pivotable about the lower edge 26 thereof to provide access to the interior of the tub portion 12 through the forward access opening 16, and to cover and seal the forward access opening 16 when the dishwasher 10 is in operation. One such prior art door assembly 100 is illustrated in FIGS. 2-4.

FIG. 2 illustrates a prior art door assembly 100 having a liner panel 102 and a separate reinforcement panel 104, wherein the liner panel 102 and the reinforcement panel 104 are fastened together and configured for attachment to the tub portion 12 (FIG. 1) of a dishwasher. The liner panel 102 is comprised of a polymeric material to form a polymeric inner lining, wherein the visible side 106 of the liner panel 102 when coupled to the reinforcement panel 104 (e.g., by screws, rivets or the like) forms the inward surface of the door assembly 100 facing the interior of the tub portion 12. The reinforcement panel 104 is coupled to the liner panel 102 for reinforcing the liner panel 102 and to provide structural integrity thereto, wherein the polymeric liner panel 102 is generally flexible and thus must be appropriately reinforced. Accordingly, the reinforcement panel 104 typically comprises a metal material, wherein the metal reinforcing panel is staked to the polymeric inner panel 102 for providing structural rigidity thereto. In such a configuration, a first surface 108 of the reinforcement panel 104 faces outwardly from the interior of the tub. In such prior art door assemblies, the metal reinforcement panel 104 may provide additional stiffness, strength, and a structure to which to attach one or more counterbalance or hinge arms (not shown) that may cooperate with the door assembly 100 to provide the pivotable engagement with the tub. Such a prior art metal reinforcement panel 104 may, for example, increase the cost of the dishwasher, and the staking process for joining the metal reinforcement panel 104 to the liner panel 102 may be difficult and labor intensive, typically resulting in excessive rework and scrap.

As shown in FIG. 3, a prior art door assembly 150 may further include an outer panel 110 for providing an exterior viewable and/or decorative portion of the door assembly 100. Thus, an exterior surface 112 of the outer panel 110 is configured to face outwardly of the interior of the tub portion so as to provide an aesthetically configured door assembly. The outer panel 110 is configured to attach to the door assembly 100 (i.e., the combined liner panel 102 and reinforcement panel 104) such that the metal reinforcement panel 104 is sandwiched therebetween. In this manner, the reinforcement panel 104 is concealed within the door assembly 100 formed between the liner panel 102 and the outer panel 110. The outer panel 110 is typically comprised of, for example, a polymeric material or a metal material such as stainless steel.

As shown in FIGS. 2 and 4, the liner panel 102 and the reinforcement panel 104 are attached or coupled together into the door assembly 100 by fasteners such as screws, rivets, or the like, or by the staking process previously disclosed. The outer panel 110 is configured to attach to the door assembly 100 by engagement features associated with the reinforcement panel 104, such as a bear claw feature 114 (FIGS. 2-5) and/or an attachment flange 116 (FIGS. 2-5), which will be recognized by those of ordinary skill in the art. As shown in FIG. 5, the bear claw feature 114 is configured to correspondingly engage with a slot 118 defined by a flange 120 of the outer panel 110. As such, the bear claw feature mates with the slot 118 for provisionally securing the outer panel 110 to the door assembly 100 (i.e., liner panel 102 and reinforcement panel 104) after which the outer panel 110 is permanently fastened to the door assembly 100 using screws, rivets or the like. As such, the various panels 102, 104, 110 function and cooperate as a unit to form the door assembly 100 which, in turn, may be engaged with the tub portion 12 so as to pivot to either close the forward access opening or permit access to the interior of the tub portion of the dishwasher.

In light of the complexity in forming the prior art door assembly 100, various embodiments of the present invention are provided to, for example, reduce the number of components needed for forming the door assembly, while also substantially reducing/eliminating the number of fasteners needed to assemble such a door assembly, thereby increasing productivity and efficiency in manufacturing the dishwashing appliance. Referring to FIG. 6, one embodiment of the present invention provides a door assembly 250 for a washing appliance (not shown), such as a dishwasher, comprising a tub portion (not shown) defining an interior for receiving dishware to be washed therein. The tub portion may further define a front access opening for allowing access to the interior of the tub portion. The door assembly 250 may be pivotably engaged with the lower end of the tub portion and configured to selectively close the front access opening, so as to block access to the interior of the tub portion, when in a substantially vertical position, wherein the door assembly 250 is capable of pivoting toward a substantially horizontal position to selectively allow access to the interior of the tub portion. In some embodiments, a pair of counterbalance and/or hinge arms (not shown) may be utilized to operably engage the door assembly 250 with the tub portion. Such counterbalance/hinge arms may be used to control or otherwise regulate the pivoting motion or pivoting engagement of the door assembly 250 with respect to the tub portion when pivoting to the substantially horizontal open position.

In some embodiments, the door assembly 250 may comprise a door panel member 200 and an outer decorative door panel member 210, wherein the door panel member 200 (otherwise referred to herein as "door panel 200") and the outer decorative door panel member 210 (otherwise referred to herein as "decorative door panel 210") may be configured to be operably engaged or secured together to form the door assembly 250. When secured together, the decorative door panel 210 is externally disposed to the door panel 200, with respect to the interior of the tub portion, wherein the decorative door panel 210 and the door panel 200 may be configured to cooperate to define a space therebetween. Further, the decorative door panel 210 may include an outwardly facing exterior surface 212 and an opposing interior surface 214. The exterior surface 212 is the externally viewable portion of the door assembly 250 when the door assembly 250 is in the substantially vertical closed position, and thus may comprise a finishing material such as, for example, stainless steel, for aesthetically providing a finished appearance. In some instances, the decorative door panel 210 may be further configured to be readily replaceable or interchangeable such that the appearance of the dishwashing appliance can be readily altered to suit, for example, individual preferences or tastes.

According to various door assembly 250 embodiments, the door panel 200 may be comprised of a variety of different polymers and/or composite materials. For example, the door panel 200 may be integrally formed as a single workpiece or otherwise integral structure (i.e., integrally-molded using materials that may include, but are not limited to: polymers and composite materials, such as, for example, a molded polymer panel or a fiberglass panel). For example, the door panel 200 may be integrally-molded or otherwise integrally-formed from a polymeric material, such as talc-filled polypropylene. In such instances, the polymeric material comprising the door panel 200 may be, for example, selected to absorb or otherwise reduce the transmission of sound/noise generated within the interior of the tub portion of the dishwashing appliance. As shown generally in FIGS. 6 and 7, the door panel 200 may comprise one or more integrally-molded members or component mounting structures that cooperate to receive and/or secure at least one or a variety of operative components thereto. For example, the door panel 200 may include integrally-formed mounting provisions for a latching device (not shown) to selectively maintain the door panel 200 in a closed engagement with the tub portion (with respect to the forward access opening), and/or a dispenser device for dispensing washing detergent and/or a rinse aid, and/or a control panel for controlling at least one operative component of the dishwashing appliance.

Embodiments of the door panel 200 of the present invention, as shown generally in FIG. 7, may be integrally formed, using heat, pressure, adhesive materials, and/or other composite material processing steps that will be appreciated by one skilled in the art such that the door panel 200 may be provided in substantially one piece (as a "single-piece" component), wherein no separate reinforcement panel or fasteners are required to form the door panel 200. The term "integrally formed" as used herein is defined as the joining of one or more structural components to form a unitary structure such that the structural components may not be separated by non-destructive means.

In some embodiments, the door panel 200 may have a tub-facing liner surface 202 and a structural surface 204, wherein the liner surface 202 is positioned to be disposed toward the tub portion of the dishwashing appliance and the structural surface 204 generally opposes the liner surface 202 and faces outwardly therefrom. Thus, the structural surface 204 substantially opposes the interior surface 214 of the decorative door panel 210 when coupled therewith to form the door assembly 250. The liner surface 202 of the door panel 200 may be contoured in a manner that facilitates cooperation between the operative components engaged with the door panel 200 (and exposed to the interior of the tub portion via the front access opening of the dishwashing appliance) and any components such as dish racks, etc. disposed within the tub portion. That is, the liner surface 202 of the door member 200 may define at least one contour which may promote, for example, appropriate clearances, or facilitate optimization of the interior capacity available within the dishwashing appliance. Further, a laterally outward-projecting flange portion 206 may be formed about a perimeter of the door panel 200 and may be configured to correspond to and cooperate with the forward access opening of the tub portion to form a substantially water-tight seal (i.e., the flange portion 206 may be configured to complementarily engage the forward access opening such that the flange engages the tub portion when the door panel 200 is in the closed position). In addition, the structural surface 204 may also be configured so as to form a recessed cavity 208 within the door assembly 250 (in conjunction with the decorative door panel 210).

As shown in FIG. 7, in some embodiments, the structural surface 204 may include one or more reinforcing members integrally-formed therewith for providing support and structure (i.e., reinforcement) to the door panel 200. For example, in some instances, the door panel 200 may include horizontal ribs 220, vertical ribs 222, and/or buttress ribs 224 molded or otherwise integrally formed therewith for providing desirable structural reinforcement, without the need for a separate reinforcing panel or other reinforcement components. More particularly, the at least one reinforcing member may be integrally formed with the structural surface 204 of the inner door 200, at least partially about a perimeter thereof, and extend in a non-parallel manner from the structural surface, generally away from the liner surface 202. In some instances, the at least one reinforcing member is engaged with the structural surface 204 so as to be covered by the decorative door panel 210 when the decorative door panel 210 is engaged with the door panel 200.

The horizontal ribs 220, vertical ribs 222, and other reinforcing members may be configured to prevent bowing, warping or other deformation of the door panel 200. Furthermore, strategic placement of ribs and other reinforcement members at or about areas of geometric transitions of the structural surface 204 (i.e., by integral formation or molding therewith) of the door panel 200, corresponding to the contour(s) defined by the liner surface 202 (i.e., where liner surface 202 of the door panel 200 is configured to have a shape transition defining a contour) may limit the visibility of or otherwise visibly conceal the ribs and other reinforcing members by minimizing the appearance of "mold sink" (i.e., contraction or shrinkage of the liner surface 202 of the door panel 200 opposite to integral attachment of the reinforcing member to the structural surface 204). Accordingly, the resulting integral component (door member 200) may be characterized as "frameless" and structurally rigid, independently of a separate reinforcement panel as required by the prior art. That is, the integrally-formed door panel 200 stands on its own as a structural door assembly capable of pivotably engaging the tub portion of the dishwashing appliance, wherein the decorative door panel 210 is non-structural and provided essentially for appearance purposes.

In some embodiments, the door panel 200 may define an opening, generally designated 240, configured, for example, to receive a dispensing device 305 (FIG. 9B) such that the dispensing device 305 may be recessed therein. Furthermore, the door panel 200 may include a vent portion 270 integrally formed therein. In addition, the molded structure of the door panel 200 may also provide recesses, mounting structures/surfaces, and/or mounting points for receiving and having securing thereto various operative components of the dishwashing appliance. In this manner, separate securing structures for securing components to the door may be eliminated. As shown in FIG. 7, the door panel 200 may define one or more engageable surfaces or mounting structures/points integrally formed (molded) therewith.

As shown in FIG. 8, the door panel 200 may also be configured to have one or more integrally-formed attachment structures for providing appropriate attachment points to other components, such as, for example, an engagement feature 242 to which to attach counterbalance/hinge arms (not shown) providing the pivotable engagement with the tub portion. In some instances, such attachment structures may be associated with the reinforcing member(s). For example, two parallel vertical ribs 222 may be supported by a plurality of transverse strengthening buttress ribs 224 to, in turn, support and provide structural reinforcement for the molded-in structures (engagement feature 242) providing the appropriate attachment points for the counterbalance/hinge arms. Because such reinforcing members are integrated with the structural surface 204 about corner contours of the liner surface 202, significant mold sink marks become less apparent with respect to the liner surface 202 of the door panel 200. As shown in FIGS. 9A and 9B, in some instances, the integrally-molded door panel 200 may also be configured to have other molded-in structures or bosses 244 for providing appropriate attachment points for attaching the dispenser device 305 used to dispense dishwashing detergent during operation of the dishwashing appliance. As such, the provision of molded-in or otherwise integrally-formed attachment features for components mated to the door panel 200 eliminates the need for separate reinforcing/attachment provisions for attaching such components thereto.

As shown in FIGS. 10A and 10B, another aspect of the door assembly 250 including the integrally-molded door panel 200 may be the provision of engagement portions such as, for example, "bear claws" 260 or "hooks" 262 configured to correspond with cooperating complementary engagement portions disposed on or defined by the outer decorative panel 210. For example, in some instances, bear claws 260 may be provided for securing the outer decorative panel 210 to the door panel 200, wherein the bear claws 260 are configured to be inserted into the slots 118 (see FIG. 5 for an example of a suitable outer decorative panel 210) of outer decorative panel 210 and directed downward so as to hook to the flange portion 320 (as similar to the flange portion 120 of FIG. 5) for securing thereto. In other embodiments, hooks 262 may be molded-in with respect to the "top" surface of the engagement feature 242 (i.e., the counterbalance/hinge arm attachment boss/rib assembly illustrated in FIG. 8). Accordingly, the outer decorative panel 210 may be first inserted over the overhanging edge of the door panel 200 and placed against the horizontal rib 220 of the door panel 200 (defining the upper limit of the outer decorative panel 210 location), before being rotated into a position whereby the flanges 320 on the sides of the outer decorative panel 210 are guided over the hooks 262 by the inclined leading edges 264 of the hooks 262, before falling into place behind the hooks 262. The outer decorative panel 210 may thus be held in-place by the effect of gravity or by an interference fit.

In accordance with further embodiments of the present disclosure, with reference to FIG. 1, the dishwasher 10 may further include a control panel 50. The control panel 50 may include a circuit board or other control unit that is otherwise in electrical communication with one or more controller elements and/or user interfaces, which may be mounted in/on the door assembly 100 (i.e., control switches mounted to the top of the door assembly 100 or the front of the door assembly 100) of the dishwasher 10. The control panel 50 may further be in communication, via a wiring arrangement 300, such as, for example, a wiring harness (FIGS. 11A and 11B), with various operational components (e.g., circulation pump, drain pump, water valve) of the dishwasher 10, wherein such operational components may thus be controlled via the control panel 50 initiated through a controller element/user interface mounted on the door assembly 100. In some instances, the operational components may be disposed within or proximate to the base portion 22 such that the wiring arrangement 300 extends from about the top portion of the door assembly 100 and along the door assembly 100 to the base portion 22.

According to some embodiments of the present disclosure, a wire covering member 350 (FIGS. 11A and 11B) may be provided to encompass the wiring arrangement 300 providing electrical communication between the control pane 50 and the various operational components of the dishwasher 10. The wire covering member 350 may, in some instances, extend substantially the entire length of the wiring arrangement 300. Although in other instances, the wire covering member 350 may extend along any suitable length of the wiring arrangement 300, such as at least partially along the length of the wiring arrangement 300. In some embodiments, the wire covering member 350 may be a tubular covering. The covering member 350 may also include ribs for providing flexibility to the covering member 350 for providing the capability of moving appropriately with the wiring arrangement 300, with respect to the door assembly 100, when the door assembly 100 pivots between the open and closed position with respect to the tub portion. In other instances, the covering member 350 may otherwise be capable of bending around the bottom of the door assembly 100 when entering the base portion 22 housing the operational components. The wire covering member 350 may define a slit extending lengthwise such that the wiring arrangement 300 can be received within the wire covering member 350 therethrough. In other embodiments, the wire covering member 350 may be configured as tape. That is, the wire covering member 350 may have an adhesive side for contacting, interacting, or otherwise engaging the wiring arrangement 300 such that the wire covering member 350 may be wrapped about the wiring arrangement 300 and maintained in engagement therewith by the adhesive substance.

The wire covering member 350 may be comprised of a flame-resistant material and/or a chemical-resistant material. As such, the wire covering member 350 may isolate the wiring arrangement 300 from the surrounding components/portions of or elements associated with the dishwasher 10. Particularly, in instances where the door assembly 250 implements embodiments of the door panel 200 as disclosed herein, the wire covering member 350 may reduce/prevent fire and/or chemical damage to the wiring arrangement 300. That is, because the door assembly 250 according to the various aspects of the present invention does not include a metal reinforcement panel 104 (FIGS. 3 and 5), as in the prior art, to provide a flame barrier, the wire covering member 350 may be wrapped or otherwise surrounded to encompass the wiring arrangement 300 to provide such protection. Such a wire covering member 350 may eliminate the need for a separate flame barrier provision. Further, the covering member 350 may be configured to be water resistant and/or chemical proof so as to be capable of resisting chemical deterioration of the wiring insulation of the wiring arrangement 300 (i.e., due to rinse aid leaking from the dispenser device 305, or water intrusion into the space between the door member 200 and the decorative panel 210) which may potentially cause a fire hazard. The wire covering member 350 may, in some instances, include a base material, such as, for example, corrugated tubing, coated with the flame-resistant and/or chemical-resistant material, while in other instances the wire covering member 350 itself may be formed of a flame-resistant and/or chemical-resistant material.

The term "flame-resistant" material as used herein is defined as a material capable of substantially withstanding elevated temperatures, such as those associated with fire, such that the material maintains its structural integrity so as to contain a fire for preventing or limiting the spread thereof. For example, the wire covering member 350 may be constructed of a material having a UL94-HBF flammability rating. In some instances, the wire covering member 350 may be constructed of a suitable polymer material, such as, for example, a thermoplastic elastomer material, or any other suitable material.

The term "chemical-resistant" material as used herein is defined as a material capable of substantially withstanding degradation, disintegration and/or destruction when exposed to chemicals that may be associated with the use of a dishwashing appliance. For example, the wire covering member 350 may be constructed of a material resistant to the deteriorating effects of rinse aid agents on the insulation of the wiring and/or wiring arrangement 300. For example, the wire covering member 350 may be constructed of a suitable polymer material, such as, for example, a thermoplastic elastomer material, or any other suitable material.

As shown in FIGS. 11A and 11B, according to some embodiments of the present disclosure, the control panel 50 (FIG. 1) may be disposed proximate to the top of the door assembly 250, while one or more operational components are disposed within the base portion 22 of the dishwasher 10. As such, the wiring arrangement 300 (e.g., a wiring harness) may extend along the door assembly 250 to provide an electrical connection between the control panel 50 and the operational components. The wiring arrangement 300 may be disposed within the door assembly 250 between the door panel 200 and the outer decorative panel 210 (not shown in FIGS. 11A and 11B) such that the wiring arrangement 300 is externally disposed with respect to the door panel 200 from the forward access opening 16/tub portion 12. That is, the wiring arrangement 300 may be disposed between the structural surface 204 of the door panel 200 and the interior surface 214 of the outer decorative panel 210. The wire covering member 350 may be wrapped or otherwise configured to surround the wiring arrangement 300. In some instances, the wire covering member 350 may only extend along a partial length of the wiring arrangement 300. For example, the wire covering member 350 may only cover the wiring arrangement 300 near or about the lower edge 26 of the door assembly 250.

In some embodiments, as the wiring arrangement 300 reaches the bottom portion/lower edge 26 of the door assembly 250, the wiring arrangement 300 may be bent or otherwise directed to the operational components housed/disposed in the base portion 22. As such, the wiring arrangement may encounter various structures/features associated with the lower edge 26/bottom portion of the door assembly 250. For example, the wiring arrangement/harness 300 may be routed over existing structures associated with the door assembly 250, and may thus rub, chafe, contact or otherwise interact with, for example, a hinge support rod 310 extending the length of the lower edge 26/bottom portion of the door assembly 250 for facilitating pivoting thereof, when opening and closing the door assembly 250. Furthermore, the wiring arrangement 300 may rub, chafe, contact or otherwise interact with a toe kick plate 320 positioned below the lower edge 26/bottom portion of the door for covering a recessed space defined by the lower portion of the dishwasher on the forward side thereof. Accordingly, the wire covering member 350 may be provided to cover the wiring arrangement 300 at portions that may be subject to such rubbing, chaffing, etc. so as to prevent the wiring insulation from being damaged, which may expose the metal wiring and possibly lead to a fire hazard. For example, the wire covering member 350 may be constructed of a chafe-resistant material, such as, for example, a durable thermoplastic elastomer material, or any other suitable material. The term "chafe-resistant" material as used herein is defined as a material capable of substantially withstanding destruction and/or degradation caused by frictional forces of a structure/feature rubbing, chaffing, contacting or otherwise acting thereon.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A door assembly for a dishwashing appliance having a tub portion defining a forward access opening, the door assembly being pivotably engaged with the tub portion and adapted to cooperate with the tub portion to cover the forward access opening, the door assembly comprising:

an integrally-formed inner door member having a liner surface facing toward the tub portion and an opposing structural surface, the inner door member being adapted to pivotably engage the tub portion about a lower end thereof, the liner surface defining at least one contour, and the structural surface having at least one reinforcing member integrally engaged therewith in correspondence with the at least one contour defined by the liner surface, so as to structurally reinforce the inner door member; and at least one attachment structure associated with the at least one reinforcing member, wherein the at least one attachment structure comprises at least one engagement feature configured to cooperate with the tub portion to provide the pivotable engagement therebetween;

wherein the at least one reinforcing member defines a plurality of vertical ribs and a plurality of transverse buttress ribs extending therebetween to provide structural reinforcement for the engagement feature;

wherein the at least one attachment structure further defines at least one hook configured to engage a complementary engagement portion associated with an outer decorative panel member to secure the outer decorative panel member to the inner door member by the effect of gravity or an interference fit.

2. A door assembly according to claim 1, wherein the outer decorative panel member has opposed interior and exterior surfaces, the outer decorative panel member being configured to engage the inner door member such that the interior surface of the outer decorative panel member substantially opposes the structural surface and covers the at least one reinforcing member associated therewith.

3. A door assembly according to claim 2, further comprising:

an elongate wiring arrangement at least partially disposed between the inner door member and the outer decorative panel member; and a covering member configured to encompass the wiring arrangement along a length thereof, and comprising at least one of a flame-resistant material and a chemical-resistant material.

4. A door assembly according to claim 3, wherein the covering member further comprises a chafe-resistant material.

5. A door assembly according to claim 3, wherein the covering member comprises a thermoplastic elastomer material.

6. A door assembly according to claim 3, wherein the covering member is tubular and is configured to receive substantially the entire length of the wiring arrangement.

7. A door assembly according to claim 3, wherein the covering member comprises a substrate material coated with at least one of the flame-resistant material and the chemical-resistant material.

8. A door assembly according to claim 1, wherein the inner door member is integrally formed of one of a polymeric material, a composite material, and a combination thereof.

9. A door assembly according to claim 1, wherein the at least one reinforcing member is integrally formed with the structural surface of the inner door member about the perimeter thereof, and wherein the at least one reinforcing member extends in a non-parallel direction from the structural surface away from the liner surface.

10. A door assembly according to claim 1, wherein the at least one attachment structure of the inner door member is adapted to receive a hinge member in engagement therewith for facilitating the pivotable engagement between the inner door member and the tub portion.

11. A door assembly according to claim 10, wherein the at least one attachment structure is integrally formed with the at least one reinforcing member.

12. A door assembly according to claim 1, wherein the at least one reinforcing member is integrally molded with the structural surface substantially in opposition to the at least one contour defined by the liner surface such that any mold shrinkage associated with the at least one reinforcing member is substantially visibly concealed.

13. A door assembly according to claim 12, wherein the at least one reinforcing member extends in a non-parallel direction from the structural surface and away from the liner surface.

14. A door assembly according to claim 12, wherein the at least one reinforcing member comprises at least one horizontal rib extending substantially across a width of the structural surface.

15. A door assembly according to claim 14, wherein the at least one reinforcing member comprises at least one vertical rib extending vertically along the structural surface and at least one buttress rib extending from the vertical rib.

16. A door assembly according to claim 1, wherein the inner door member is further configured to receive a latch device in operable engagement therewith, the latch device being adapted to cooperate with the tub portion to selectively maintain the inner door member in a closed position with respect to the forward access opening.

17. A door assembly according to claim 1, wherein the inner door member is further configured to define a component structure, the component structure being adapted to receive at least one operative component of the dishwashing appliance.

18. A door assembly according to claim 17, wherein the component structure comprises an opening configured for receiving a dispenser device and at least one integrally-formed attachment structure configured to facilitate attachment to the dispenser device.

19. A door assembly according to claim 18, wherein the integrally-formed attachment structure extends at least partially into the opening and is further configured to receive the dispenser device.

20. A door assembly according to claim 1, further comprising a control assembly operably engaged with the inner door member and adapted to selectively direct operation of at least one operational component of the dishwashing appliance.

21. A dishwashing appliance comprising:

a tub portion having a plurality of wall members defining a forward access opening; and a door assembly configured to cooperate with the tub portion to cover the forward access opening, the door assembly comprising:

an integrally-formed inner door member having a liner surface facing toward the tub portion and an opposing structural surface, the inner door member being configured to pivotably engage the tub portion about a lower end thereof, the liner surface defining at least one contour, and the structural surface having at least one reinforcing member integrally engaged therewith in correspondence with the at least one contour defined by the liner surface so as to structurally reinforce the inner door member; and at least one attachment structure associated with the at least one reinforcing member, wherein the at least one attachment structure comprises at least one engagement feature configured to cooperate with the tub portion to provide the pivotable engagement therebetween;

wherein the at least one reinforcing member defines a plurality of vertical ribs and a plurality of transverse buttress ribs extending therebetween to provide structural reinforcement for the engagement feature;

wherein the at least one attachment structure further defines at least one hook configured to engage a complementary engagement portion associated with an outer decorative panel member to secure the outer decorative panel member to the inner door member by the effect of gravity or an interference fit.

22. A dishwashing appliance according to claim 21, wherein the outer decorative panel member has opposed interior and exterior surfaces, the outer decorative panel member being configured to engage the inner door member such that the interior surface of the outer decorative panel member substantially opposes the structural surface and covers the at least one reinforcing member associated therewith.

23. A dishwashing appliance according to claim 22, further comprising:

an elongate wiring arrangement at least partially disposed between the inner door member and the outer decorative panel member; and a covering member configured to encompass the wiring arrangement along a length thereof, and comprising at least one of a flame-resistant material and a chemical-resistant material.

24. A dishwashing appliance according to claim 23, wherein the covering member further comprises a chafe-resistant material.

25. A dishwashing appliance according to claim 23, wherein the covering member comprises a thermoplastic elastomer material.

26. A dishwashing appliance according to claim 23, wherein the covering member is tubular and is configured to receive substantially the entire length of the wiring arrangement.

27. A dishwashing appliance according to claim 23, wherein the covering member comprises a substrate material coated with at least one of the flame-resistant material and the chemical-resistant material.

28. A dishwashing appliance according to claim 21, wherein the inner door member is integrally formed of one of a polymeric material, a composite material, and a combination thereof.

29. A dishwashing appliance according to claim 21, wherein the at least one reinforcing member is integrally formed with the structural surface of the inner door member about the perimeter thereof, and wherein the at least one reinforcing member extends in a non-parallel direction from the structural surface away from the liner surface.

30. A dishwashing appliance according to claim 21, wherein the at least one attachment structure of the inner door member is configured to receive a hinge member in engagement therewith for facilitating the pivotable engagement between the inner door member and the tub portion.

31. A dishwashing appliance according to claim 30, wherein the at least one attachment structure is integrally formed with the at least one reinforcing member.

32. A dishwashing appliance according to claim 21, wherein the at least one reinforcing member is integrally molded with the structural surface substantially in opposition to the at least one contour defined by the liner surface such that any mold shrinkage associated with the at least one reinforcing member is substantially visibly concealed.

33. A dishwashing appliance according to claim 21, wherein the inner door member is further configured to receive a latch device in operable engagement therewith, the latch device being configured to cooperate with the tub portion to selectively maintain the inner door member in a closed position with respect to the forward access opening.

34. A dishwashing appliance according to claim 21, wherein the inner door member is further configured to define a component structure, the component structure being configured to receive at least one operative component of the dishwashing appliance.

35. A dishwashing appliance according to claim 21, further comprising a control assembly operably engaged with the inner door member and configured to selectively direct operation of at least one operational component of the dishwashing appliance.

36. A method of forming a dishwashing appliance, the dishwashing appliance including a tub portion having a plurality of wall members and defining a forward access opening, the method comprising:

pivotably engaging a door assembly with the tub portion about a lower end thereof such that the door assembly cooperates with the tub portion to cover the forward access opening thereof, the door assembly comprising:

an integrally-formed inner door member having a liner surface facing toward the tub portion and an opposing structural surface, the inner door member being configured to pivotably engage the tub portion about a lower end thereof, the liner surface defining at least one contour, and the structural surface having at least one reinforcing member integrally engaged therewith in correspondence with the at least one contour defined by the liner surface so as to structurally reinforce the inner door member; and at least one attachment structure associated with the at least one reinforcing member, wherein the at least one attachment structure comprises at least one engagement feature configured to cooperate with the tub portion to provide the pivotable engagement therebetween;

wherein the at least one reinforcing member defines a plurality of vertical ribs and a plurality of transverse buttress ribs extending therebetween to provide structural reinforcement for the engagement feature;

wherein the at least one attachment structure further defines at least one hook configured to engage a complementary engagement portion associated with an outer decorative panel member to secure the outer decorative panel member to the inner door member by the effect of gravity or an interference fit.

37. A method according to claim 36, further comprising engaging the outer decorative panel member, the outer decorative panel member having opposed interior and exterior surfaces, with the inner door member such that the interior surface of the outer decorative panel member substantially opposes the structural surface and covers the at least one reinforcing member associated therewith.

38. A method according to claim 37, further comprising engaging the hook of the at least one attachment structure associated with the at least one reinforcing member with the complementary engagement portion associated with the outer decorative panel member, so as to secure the outer decorative panel member to the inner door member.

39. A method according to claim 37, further comprising at least partially disposing an elongate wiring arrangement between the inner door member and the outer decorative panel member.

40. A method according to claim 39, further comprising operably engaging a covering member about the wiring arrangement along a length thereof, the covering member being comprised of at least one of a flame-resistant material, a chemical-resistant material, and a chafe-resistant material.

41. A method according to claim 36, further comprising pivotably engaging the at least one attachment structure associated with the at least one reinforcing member, with the tub portion, so as to provide the pivotable engagement therebetween.

42. A method according to claim 41, wherein pivotably engaging at least one attachment structure with the tub portion further comprises engaging the at least one attachment structure of the inner door member with a hinge member in engagement with the tub portion so as to facilitate the pivotable engagement between the inner door member and the tub portion.

43. A method according to claim 42, further comprising integrally forming the at least one attachment structure with the at least one reinforcing member.

44. A method according to claim 36, further comprising integrally forming the inner door member of one of a polymeric material, a composite material, and a combination thereof.

45. A method according to claim 36, further comprising integrally forming the at least one reinforcing member with the structural surface of the inner door member, about the perimeter thereof, such that the at least reinforcing member extends in a non-parallel direction from the structural surface away from the liner surface.

46. A method according to claim 36, further comprising integrally molding the at least one reinforcing member with the structural surface, substantially in opposition to the at least one contour defined by the liner surface, such that any mold shrinkage associated with the at least one reinforcing member is substantially visibly concealed.

47. A method according to claim 36, further comprising operably engaging a latch device with the inner door member, the latch device being configured to cooperate with the tub portion to selectively maintain the inner door member in a closed position with respect to the forward access opening.

48. A method according to claim 36, further comprising engaging at least one operative component of the dishwashing appliance with a component structure defined by the inner door member.

49. A method according to claim 36, further comprising operably engaging a control assembly with the inner door member, the control assembly being configured to selectively direct operation of at least one operational component of the dishwashing appliance.

* * * * *